United States Patent [19]

Cerdan

[11] 4,172,768

[45] Oct. 30, 1979

[54] AUTOMOBILE VEHICLE DOOR LOCK

[76] Inventor: Jacques Cerdan, 14, rue de la Blanchisserie, Sully-sur-Loire, France, 45600

[21] Appl. No.: 856,106

[22] Filed: Nov. 30, 1977

[30] Foreign Application Priority Data

Nov. 30, 1976 [FR] France ..... 76 35998

[51] Int. Cl.[2] ..... E05C 3/26

[52] U.S. Cl. ..... 292/216

[58] Field of Search ..... 292/216, 41, 280

[56] References Cited

U.S. PATENT DOCUMENTS

| | | | |
|---|---|---|---|
| 3,123,390 | 3/1964 | Sandor et al. | 292/DIG. 41 |
| 3,432,198 | 3/1969 | Connor | 292/DIG. 41 |
| 3,667,792 | 6/1972 | Torll | 292/216 |
| 3,848,911 | 11/1974 | Watermann et al. | 292/216 |
| 3,985,381 | 10/1976 | Kobayashi | 292/216 |

*Primary Examiner*—Richard E. Moore

*Attorney, Agent, or Firm*—Brisebois & Kruger

[57] ABSTRACT

A vehicle door lock having a forked latch includes a knuckle joint mechanism with a link thereof articulated at one end to the lock housing and at the other end to the other member of the knuckle (namely a catch member) which, in the closed position of the door lock, holds said forked latch firmly around a corresponding pin of the lock keeper. The knuckle joint mechanism is spring urged to an "over center" position in which the point of engagement of said pin and said latch member has overshot a position of alignment with a line through the articulation axes of said link.

Advantageously the keeper pin is at least in part formed of shock absorbing material.

9 Claims, 6 Drawing Figures

AUTOMOBILE VEHICLE DOOR LOCK

The present invention concerns door locks for automobile vehicles, and more precisely locks in which a fork-shaped latch member in a housing mounted on the door comes into engagement with a keeper fixed to the body door jamb and is essentially constituted by a pin. Upon closing, the latch member rotates about its spindle due to the engagement of the forked latch member with the keeper pin and is locked, in general in two successive positions of closing, by a catch member cooperating with a catch cam carried by the forked latch member.

Door locks of automobile vehicles are subjected to highly demanding Standards, in particular with regard to their resistance to rupture or bursting. It is for this reason that they must, in accordance with the U.S. Government Standards, resist a lateral force of 906 Kg, a value which in practice the lock must be designed to exceed by a margin of 20% in order to allow for variations due to mass production tolerances. In locks of the forked latch type known to date, the latch fork works in cantilever fashion about a spindle, that is to say it turns about a fixed axis; only its prong (referred to hereinafter as the front prong), provides an abutment for the keeper pin, and the catch member is urged by a spring into engagement with the opposing side of the latch member to that side of the member which forms the fork, this being the side on which catch teeth of the catch member are formed. As a result the prong of the fork must be able to resist a force of greater than 1 tonne, and (i) the part of the latch member surrounding the axis, (ii) the catch teeth and (iii) the catch member must all be able to resist corresponding forces, thus giving rise to the designing of massive lock members, and to a lock which itself is cumbersome. Further, the catch member must be urged against the catch cam of the latch member, adding to the harsh impact of the keeper pin against the latch member and thereby resulting in noisy operation. Furthermore, the opening force which must thrust the catch member aside against the return force of its spring is also high and this prohibits the adoption of an electromagnetic opening signal using a small size electromagnet.

It is an object of the present invention to remedy these disadvantages.

In accordance with the present invention, therefore, we provide a vehicle door lock comprising a forked latch cooperating with a keeper whose catch element is a pin which comes into engagement with the fork of the latch, comprising a knuckle joint mechanism cooperating with the latch member to lock the latch member in position, said knuckle joint mechanism comprising a catch member pivoted to the end of a link whose other end is pivoted to the housing, and the knuckle joint mechanism being spring biased towards a position corresponding to overshooting of the point of contact of the catch member on the latch member beyond the straight line passing through the two pivot axes of the link.

To open a conventional forked latch type of lock it is necessary to overcome not only the force of the catch member biasing spring but also the frictional force of the catch member on the face of the catch tooth of the latch member, a force which is increased by the fact that the door, in closed position, is generally subjected (by the resilience of the door sealing rubbers) to a tendency for opening which, in combination with the return spring of the latch, creates a moment urging the catch tooth of the latch member under load against the catch member. With the knuckle joint mechanism in accordance with the present invention, this "opening" force may be exerted directly along the knuckle joint mechanism and does not therefore modify the force necessary to ensure opening, this force being substantially equal to the force of the bias spring of the knuckle joint mechanism which is even weaker than the return spring of the latch member.

The catch member is guided by a device forming a sliding guide which takes up slack to come into abutment substantially at one of the limits of its travel when the knuckle joint mechanism is in a straight line configuration. The sliding guide may, for example, be constituted by an aperture provided in the catch member, which aperture slidably receives a pin fixed rigidly to the lock housing.

The catch member preferably comprises two teeth one of which forms the bearing surface cooperating with the edge of the catch cam of the latch member and the other of which comes into engagement in the "closed" position behind the front prong of the forked latch. In the "closed" position, the second tooth of the catch member is advantageously engaged between the front prong of the latch fork and an abutment fixed to the lock housing to use the housing abutment as the reaction member to resist the lock bursting force. The mechanical resistance of the lock may thus be substantially increased because, the free end of the leading prong of the fork being in practice in abutment with the casing, the fork cannot open by mechanical bending deformation.

In one embodiment, at least a part of the peripheral surface of the keeper pin is made of a substance providing a speed of transmission of mechanical shock waves different from that of the metal constituting the lock and this part may preferably be limited to a strip situated to either side of the generatrix along which the latch member comes into abutment against the keeper spindle at the onset of engagement therebetween upon closing. Said substance which presents a speed of transmission of shock waves different from that of the metal constituting the lock is in general a resilient substance.

In one embodiment, the keeper pin cooperating with the forked latch is constituted by two nested split ferrules defining a T-shaped groove open towards the exterior in which groove a strip of resilient material of corresponding shape is held captive; a pin, in general the fixing screw of the keeper, being inserted through the inner ferrule. In the "closed" position of the lock, the point of contact of the rear prong of the fork with the keeper has advantageously moved onto the outer ferrule itself and left the strip of resilient material, thus avoiding damaging the strip by vibrations of the door.

In order that the present invention may more readily be understood there will now be described one embodiment of an automobile door lock in accordance with the invention, reference being made to the accompanying drawings in which.

Figure 1:
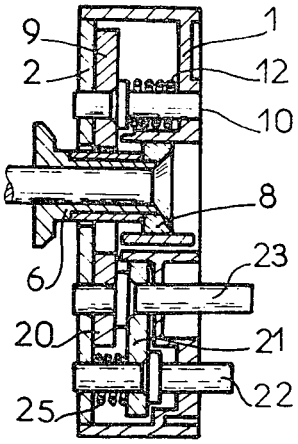
FIG. 1 is a sectional view of the lock along line I—I of FIG. 2.

The lock shown in the drawings comprises a housing 1, and a cover 2 fixed to the housing, the assembly of housing and cover being fixed to the door by screws or bolts passing through holes 3 of pillars 4 formed in the housing. The housing and the cover present a large open notch 5 for engagement of the front pin 6 and the rear pin 7 of the keeper 8.

The lock comprises a fork-shaped latch member 9 mounted in the casing for rotation about a spindle 10 and urged for rotation in the anti-clockwise sense by the end limbs 11 of a coil torsion spring 12 around the spindle 10 and bearing against a rib 13 at the bottom of the housing and a notch 14 on the side of the latch member. The latch member itself comprises, on the part of its periphery facing towards the notch 5, a slot 15 having a semi-circular end and separating the front and rear prongs 16 and 17 of the fork. Above the front prong 17, the side of the latch member has firstly a step 18 which forms the stop surface for the first catching position of the door, as shown in FIG. 3, and then a cam region 19 of greater radius of curvature which maintains the catch member held in the "open" position of the lock as shown in FIG. 2.

Figure 5:
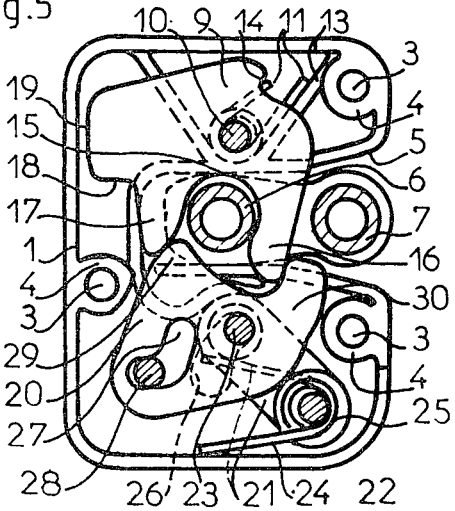
FIG. 5 is a view, corresponding to FIG. 2, showing the lock in its closed position.

The knuckle joint mechanism comprises a catch member 20, which will be described hereafter, and a link 21 which is pivotally mounted in the housing about a spindle 22 penetrating one end of the limb. The spindle 23 at the other end of the link 21 pivotally supports the catch member 20. The two end limbs 23 of a coil torsion spring 25 around the spindle 22 bears against the housing and the spindle 23 for biasing the link 21 in the clockwise direction. This spindle 23 passes through a circular slot 26 in the housing such that the protruding end of the spindle 23 may be connected to door opening means of a manually or electrically operated type. Such opening means do not form a part of this invention and need not be described in detail herein. In its limit position abutting the end of the slot 26, the spindle 23 also defines the freedom for over centre movement of the link 21 beyond the position of alignment of (a) the point of contact at door closing engagement with (b) the straight line passing through the pivot axis of spindles 23 and 22, as shown in FIGS. 3 and 5. The catch member 20 comprises a guide aperture 27 of J-shape which slidably receives a pin 28 fixed to the casing, a catch nose 29 which forms a first catch tooth of the catch member and cooperates with the cam-forming edge of the latch member, and an engagement finger 30 forming a second catch tooth. The biasing force exerted on the catch member 20 by the spring 25 bearing on the spindle 23 is such that the catch member 20 moves so as to bring the J-shaped slot 27 into engagement, with its lower end portion of greatest eccentricity with respect to the spindle 23, against the pin 28. The second catch tooth 30 advantageously has a form such that when the pin 28 is in the lower end part of the J slot 27 this finger may bear with its front edge against an abutment in the form of the adjacent tooth pillar 4 of the housing and its rear edge may be in contact, or nearly in contact, with the end part of the leading edge of the front prong of the fork in the "closed" position. This has the effect of using the pillar 4 to resist any bursting force on the lock catch member 20 rather than relying on the strength of the catch member 20 or that of the latch member 9 to be sufficient to bear all the load.

There will now be described the operation of the lock described above with reference to FIGS. 2 to 5.

Figure 2:
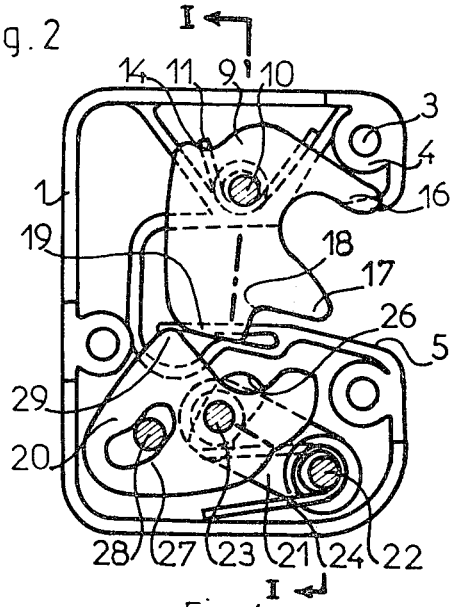
FIG. 2 is an elevational view of the lock in open position, the cover of the housing having been removed.
Figure 3:
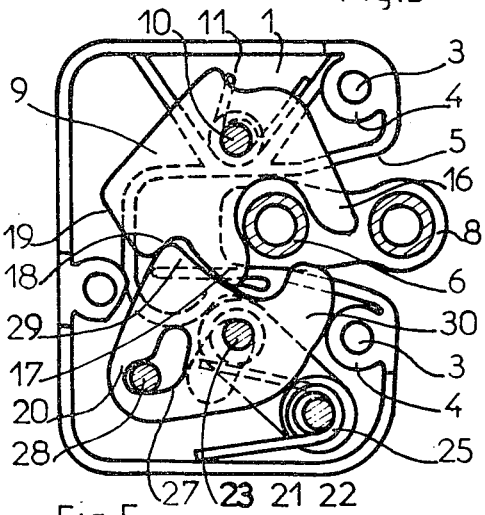
FIG. 3 is a view, corresponding to FIG. 2, showing the lock at the first closing notch.

In FIG. 2, the lock is shown in the open condition. Under the action of the torsion spring 12, the latch member 9 has rotated to the maximum extent in the anticlockwise sense and the leading side of the front prong 16 of the fork is in engagement with the nearby pillar 4 which limits its pivoting. To ensure this placing of the latch in "open" position, the spindle 23 has been driven for rotation, by actuation of a door lock control knob or lever or by any suitable electric or other automatic means, around the axis of spindle 22 along the slot 26 in the anticlockwise direction, this having had the result of bringing the upper end of the slot 27 onto the pin 28 due to the fact that the spindle 23 has been drawn nearer the pin 28 which is only possible by virtue of sliding of the slot 27 along the pin 28. The first latch tooth 29 of the catch member has descended, thus separating from the catch cam-forming surface 19 of the latch member 9. Upon freeing of the spindle 23, that is to say by means of the door lock "opening" control, the spindle 23, and hence the link 21, will be driven for rotation by the spring 25 in the clockwise sense aroung the spindle 22. The catch member 20 tends to rise again, and the J slot slides with respect to the pin 28. During this movement, the first catch tooth 29 will abut the cam edge 19 of the latch member 9 as shown in FIG. 2 and the lock is open.

When the door is closed again, the pin 6 of the keeper enters the cut-out 5 of the housing and comes into contact with the leading edge of the rear prong 17 of the latch fork. The latch member 9 thus rotates about the spindle 10, starting to wind up the coil spring 12. During this rotation of the latch member 20 the first catch tooth 29 of the catch member 20 is in abutment with the cam edge 19 and is resisted up to the moment when it is contacted by the step 18. At this instant, since the catch member 20 is no longer resisted, the link 21 will be free to rotate around the spindle 22 in the clockwise direction under the action of its biasing spring 24 and the lower pat of the J slot 27 comes onto the pin 28. The leading edge of the second tooth 30 comes into abutment against the nearby pillar 4. The point of engagement between the side of the latch on the right of the step 18 and the first tooth 29 is thus substantially on the straight line passing through the pivot axes of the two spindles 23 and 22. In this position the moment exerted on the latch member 9, when the door is urged towards the open position, is borne by the knuckle joint mechanism which finds itself in locked position in that the link 21 is subjected to an axial compression but with no component of force in a direction giving a moment which would counterbalance the spring 25.

Figure 4:
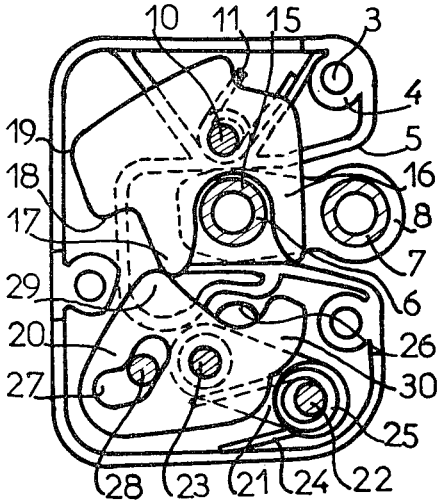
FIG. 4 is a view, corresponding to FIG. 2, during passage from the first to the second closing notch.

If the closing movement of the door is continued to the position shown in FIG. 4, the rear face of the rear prong 17 of the latch fork 9 acts as a cam for depressing the first tooth 29 of the catch member 20. The link 21 will then be caused to rotate in the anti-clockwise sense at the same time as the upper end of the J slot 27 approaches the pin 28. When the first tooth 29 of the catch member 20 has ridden over the tip of the rear prong 17 of the latch member 9, it engages behind the leading edge of this rear prong as shown in FIG. 5 and the link 21 will rotate, under the influence of the spring 25, in the clockwise sense to bring the point of contact between the latch and the catch member once more into alignment with the spindles 23 and 22 to ensure re-locking of the knuckle joint mechanism as it was in the FIG. 3 position. The second tooth 30 returns into contact with the nearby pillar 4 but it also projects up in front of the leading edge of the tip of the front prong 16 of the forked latch member 9 (see FIG. 5) to hold the latch member 9 in the closed position. As a result if the front prong 16 is mechanically deformed under the effect of a violent door opening shock force it will, possibly after a deformation to take up the very small play which exists between the tooth 30 and prong 16 and pillar 4, engage with the tooth 30 which adds its deformation resistance to the closing effect from the engagement of prong 17 with tooth 29. Furthermore, this complementary resistance of the tooth 30 will be increased when and if the tooth 30, by deformation, comes into engagement with the pillar 4 which then constitutes a fixed point of the door.

Any tendency for the latch member 9 to pivot in the anti-clockwise sense to its open position under such a shock load will tend to pull the catch member 20 to the right but this will only force the pin 28 even more firmly against the end of the lower position of J slot 27. This would leave clockwise pivoting of the latch member 20 about pin 28 as the only movement which could release the prong 16 but even this movement is resisted by the fact that the longitudinal axis of link 21 is substantially perpendicular to the line joining the axis of pin 28 and spindle 23 so the link will just be placed under compressive load.

The safety limit of the lock is thus practically doubled with respect to that of any known forked latch lock.

Figure 6:
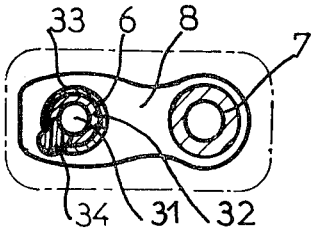
FIG. 6 is a sectional view of the keeper taken in a plane perpendicular to the axis of its pin.

To improve the characteristics of silent operation of this lock, resulting from the fact that the accelerations of the component parts, such as the catch member 20, are less than those of the components of the known type of lock, and generally to reduce the working noise of forked latch locks of known types, the pillar or pin 6 of the keeper can be designed as shown in FIG. 6. Into the central bore 31 of this hollow cylindrical pin is engaged, in known manner, one of the fixing screws for mounting the keeper on the vehicle body. The hollow pin is constituted by two concentric ferrules 32 and 33. The slit of the internal ferrule 32 subtends, at the centre of bore 31, an angle which is greater than that for the outer ferrule 33 so as to form a recess of substantially T cross-section in which is received a strip 34 of a resilient material whose body projects radially outwardly from the surface of the outer ferrule 33. With this keeper, during closing movement and in particular during the phase illustrated in FIG. 3, the pin of the keeper comes into contact with the leading edge of the rear prong 17 of the latch member 9 by this resilient projection 34 which reduces noise still further. During later phases of the closing operation (FIGS. 4 and 5) the latch member 9 is in contact with the outer ferrule 33 thereby avoiding damaging the strip 34.

Numerous modifications may be made to the embodiment described above by way of Example, without departing from the scope of the present invention as defined in the claims annexed hereto. It is further to be noted that with regard to the keeper construction shown in cross-section in FIG. 6, the pin 6 of the keeper may also be covered over its entire periphery by a jacket of supple, semi-rigid or rigid material or it may itself be formed or a rigid material which acts as a shock absorber.

Further, with regard to the operation of the lock, the catch engagement of the catch member 20 with the latch member 9 might be essentially by engagement of the second tooth 30 in front of the leading prong 16 of the forked latch member 9, this being obtained by applying the existing play between the prong 16 and the second tooth 30 to the point of contact between the rear prong 17 of the fork and the first tooth 29, the tooth 29 then acting somewhat as a safety catch between the front prong 16 of the latch member 9 and the second tooth 30 of the catch member 20.

I claim:

1. In a vehicle door lock comprising a housing adapted to be secured to a vehicle door; a forked latch member mounted movably within said housing and having first and second prongs; and comprising a keeper catch element which is adapted to be mounted on a vehicle body and is constituted by a pin coming into engagement with the fork of the latch, the improvement wherein (a) said housing includes a knuckle joint mechanism arranged to cooperate with said forked latch member for locking the latch member in position;

(b) said knuckle joint mechanism includes a link one end of which is articulated to the casing, and a catch member articulated to the other end of said link; and (c) a spring carried by said housing biases the knuckle joint mechanism towards a position corresponding to overshooting of the point of engagement of the catch member on said forked latch member beyond a position of alignment with the axes of the two articulations of said link.

2. A lock according to claim 1, and including sliding guide means to orientate the catch member of the knuckle joint mechanism.

3. A lock according to claim 2, wherein said sliding guide means comprise means defining a slot formed in the catch member, and a pin carried by said housing and engaged slidably in said slot.

4. A lock according to claim 1, and including first and second tooth means formed on said catch member of the knuckle joint mechanism; said first tooth means forming a bearing surface cooperating with said first prong of said forked latch member and the said second tooth means coming into engagement, in the closed position of the lock, behind said second prong of the forked latch member to hold said door closed.

5. A lock according to claim 4 and including an abutment fixed to the housing of the lock and positioned so that, in the closed position of the lock, said second tooth of the catch member of said knuckle joint mechanism is engaged between said second prong of the latch fork and said abutment.

6. A lock according to claim 1, wherein said lock is formed of metal, and at least a part of the peripheral surface of said pin of the keeper is formed of a substance having a speed of transmission of mechanical shock waves different from that of the metal constituting the lock.

7. A lock according to claim 6, wherein only a part of the peripheral surface of the pin of the keeper is formed of said substance, and said part is limited to a zone disposed to either side of the generatrix along which the forked latch member comes into abutment with the keeper pin at the beginning of engagement therebetween upon closing of the door.

8. A lock according to claim 6, wherein said substance is a resilient material.

9. A lock according to claim 6, wherein said pin of the keeper cooperating with the latch fork is constituted by two coaxial nested split collars defining a T groove open towards the exterior of said pin and receiving a strip of resilient substance of corresponding shape, whereby said strip defines said part of the pin made of said substance.

* * * * *